US007080531B2

(12) United States Patent
Vitry et al.

(10) Patent No.: US 7,080,531 B2
(45) Date of Patent: Jul. 25, 2006

(54) TWO POINT LATCHING SYSTEM

(75) Inventors: Fabrice Vitry, Worcester (GB); Andrew Thornton, Kingswinford (GB)

(73) Assignee: Southco, Inc, Concordville, PA (US)

( * ) Notice: Subject to any disclaimer, the term of this patent is extended or adjusted under 35 U.S.C. 154(b) by 0 days.

(21) Appl. No.: 10/612,377

(22) Filed: Jul. 1, 2003

(65) Prior Publication Data

US 2004/0118171 A1 Jun. 24, 2004

Related U.S. Application Data

(60) Provisional application No. 60/393,181, filed on Jul. 1, 2002, provisional application No. 60/435,086, filed on Dec. 19, 2002.

(51) Int. Cl.
*E05B 13/10* (2006.01)

(52) U.S. Cl. ..... 70/208; 70/84; 70/478; 70/DIG. 54; 292/11; 292/30; 292/31; 292/56; 292/120; 292/127; 292/128; 292/227; 292/228; 292/DIG. 37; 292/DIG. 61

(58) Field of Classification Search ..... 70/208, 70/467, 471, 473–480, 483–485, 137, 139, 70/84, DIG. 54, DIG. 55; 292/227, 228, 292/56, 116, 117, 119, 120, 11, 30, 31, 53, 292/54, 127, 128, 122, 218, 213.214, 219, 292/220, 50, DIG. 37, 125, 225, DIG. 61
See application file for complete search history.

(56) References Cited

U.S. PATENT DOCUMENTS 2,313,712 A * 3/1943 Jacobi ..... 70/451
2,454,926 A * 11/1948 Jacobi ..... 70/84
2,690,920 A * 10/1954 Richbourg ..... 292/54
2,803,956 A * 8/1957 Womer ..... 70/63
3,003,348 A * 10/1961 Jacobi ..... 70/84
3,220,759 A * 11/1965 Miller ..... 292/120
3,572,062 A * 3/1971 Beebe ..... 70/1.5
3,656,789 A * 4/1972 Ray ..... 292/304
3,677,591 A * 7/1972 Waldo ..... 292/221
3,834,780 A * 9/1974 McClellan et al. ..... 312/219
4,057,273 A * 11/1977 Carr ..... 292/218
4,134,281 A * 1/1979 Pelcin ..... 70/208
4,637,648 A * 1/1987 Okino et al. ..... 296/63
5,224,743 A * 7/1993 Dawdy et al. ..... 292/228
5,718,467 A * 2/1998 Weinerman et al. ..... 292/218
5,901,501 A * 5/1999 Fountaine ..... 49/449
6,085,928 A * 7/2000 Dickinson et al. ..... 220/324
6,666,484 B1 * 12/2003 Branch et al. ..... 292/128
2002/0190529 A1 * 12/2002 Breslin et al. ..... 292/56

* cited by examiner

*Primary Examiner*—Lloyd A. Gall
(74) *Attorney, Agent, or Firm*—Paul & Paul

(57) ABSTRACT

The present invention relates to a latch having a button pawl shaft for attaching two panels together at two different points. The shaft of the latch has bezels in which the shaft rotates connected to one of the panels. The shaft has pawls at both ends which engage a keeper on a second panel and disengage and clear the keeper when a force is applied to the button on the shaft thereby rotating the shaft. A precompressed torsion spring provides a force on the button at all times. When a user presses on the button thereby rotating the shaft such that the pawls disengage with keepers the spring will rotate the shaft and button back to the same position as that prior to the user applying a force on the button.

17 Claims, 20 Drawing Sheets

TWO POINT LATCHING SYSTEM

CROSS REFERENCE TO RELATED APPLICATIONS

This application claims the benefit of U.S Provisional Application 60/393,181 filed Jul. 1, 2002 and U.S. Provisional Application 60/435,086 filed Dec. 19, 2002.

BACKGROUND OF THE INVENTION

The present invention relates to latches for securing together two panel members at two points by a pawl at each point. The latches can be repeatedly latched and unlatched by a user who desires to fasten and unfasten the panels together.

Various latches are known for securing together panel members at two points. Previously, a latch having two pawls and a button could not be made from one piece due to warpage which would occur if one were to attempt to mold the pieces. Accordingly, defects due to warpage would lead to unreliable operation of the latch.

The above described latches can be used in compartments, bins and panels in various locations such as glove compartments and storage areas in vehicles.

SUMMARY OF THE INVENTION

The present invention is directed to a two point latch for securing an upper and a lower panel.

In accordance with the present invention, it is an object to provide a latch for securing together two panels in a fastened position. When the latch is unlatched the two panels become unfastened and a user can refasten the two panels together by raising the lower panel until the lower and upper panel are fastened together by the action of the latch.

It is another object of the invention to provide a latch which includes a lockable button such that the latch can be secured and only opened when a key is inserted in the lock.

The present invention in one embodiment comprises a single piece shaft having a button, and two pawls wherein one pawl is on each side of the button and the shaft extends through a bezel which is secured to one of the two panels which are to be fastened. A torsion spring at each of the bezels is provided which maintains a force on the button even when the two panels are secured together in a closed position. The torsion spring can be inserted in the latch in a compressed position in order to minimize any rattling noise or slack which may arise during operation of a vehicle in which the latch is installed. The torsion springs also keep a force on the shaft when the latch is in the closed position thereby ensuring that the two panels stay fastened. This is accomplished by the installation of a precompressed spring in the latch which is always under compression.

Another object of the invention is to provide a latch comprising a button pawl shaft having a button which is so constructed that the button of the latch is aligned with a rib on one of the panels around which portions of a lockplug in the button can fit when the button is unlocked. When the button is unlocked by the rotating action of the lockplug, portions of the shaft can be aligned with a rib which in turn ensures that two opposed portions of the lockplug that move along each side of the rib are aligned and are guided by the rib. The pawls of the shaft clear keepers when the shaft is in the open position.

It is yet another object of the invention to provide a latch which allows two panels to be fastened by a slam action and which allows the pawls on the shaft to be placed to remain engaged with a keeper by the force of a spring acting on the shaft. This is accomplished by the ramp shape of the top of the pawls which interacts with the keepers.

Another embodiment of the present invention is directed to a button pawl shaft made from three snap together pieces for securing to a keeper on an upper structure and a lower structure to which the button pawl shaft is connected.

This embodiment comprises a three-piece shaft having a button on one piece, and a pawl on a second piece which snap fits into one end of the first piece, and a pawl on a third piece which snap fits into the other end of the first piece. When the three pieces are assembled one pawl is on each side of the button and the shaft extends through bezels which are secured to one of the two structures which are to be fastened. A torsion spring at each of the bezels is provided which maintains a force on the button even when the two structures are secured together in a closed position.

These and other objects of the present invention will be more readily apparent when taken into consideration with the following description and the attached drawings.

DETAILED DESCRIPTION OF THE INVENTION

Figure 1:
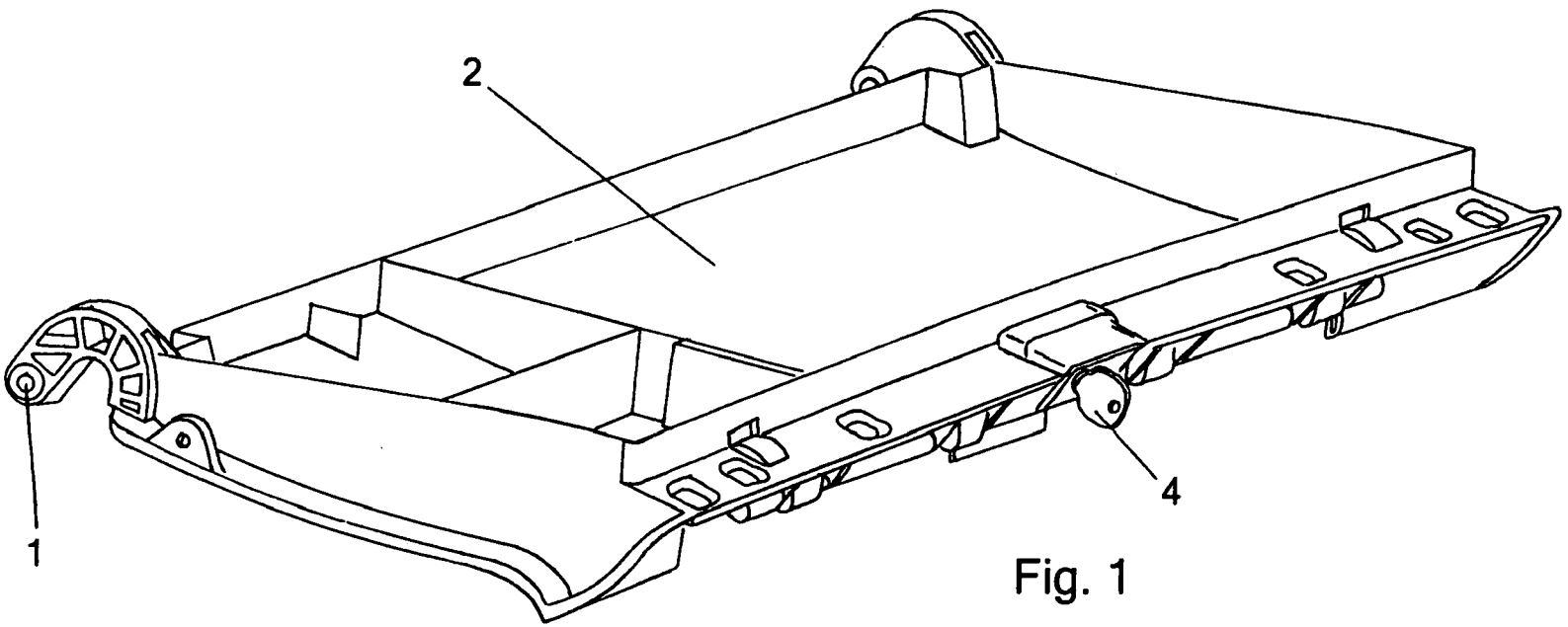
FIG. 1 is a perspective view of a preferred embodiment of a latch in accordance with the present invention with an inner bin piece.
Figure 2:
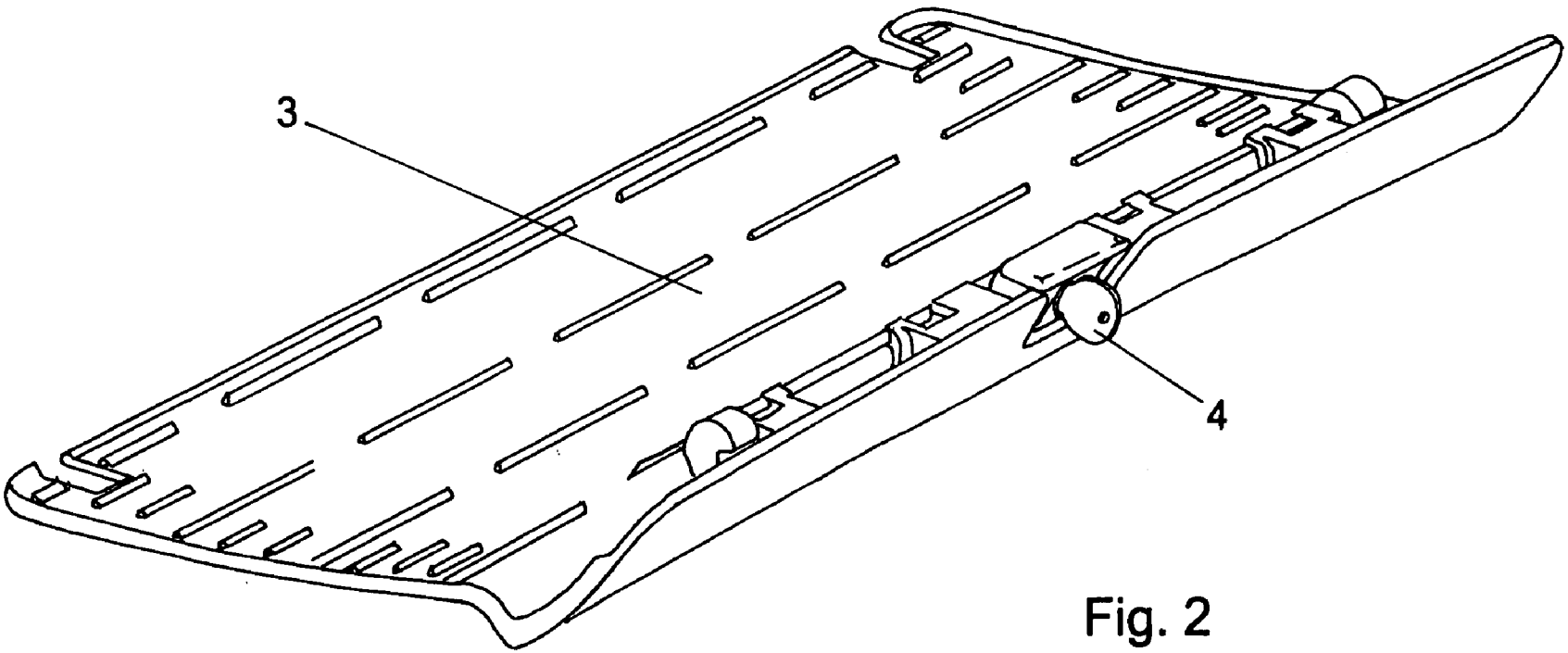
FIG. 2 is a perspective view of the latch of FIG. 1 with an outer bin piece.
Figure 3:
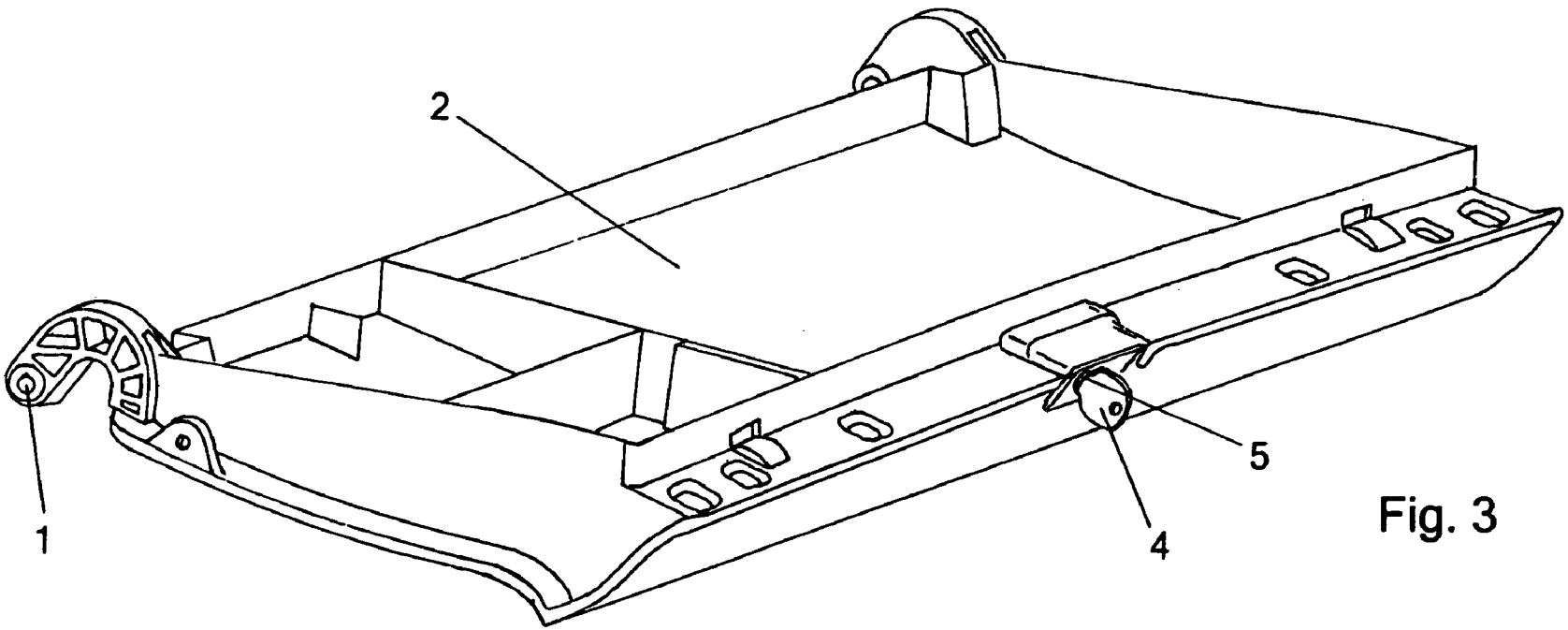
FIG. 3 is a perspective view of the latch of FIG. 1 with an inner bin piece and an outer bin piece.

Referring now to the drawings in detail, wherein like reference numerals indicate like elements through the several views, there is shown in FIG. 1–3, a perspective view of a preferred embodiment of a latch 16 in accordance with the present invention with an inner bin piece 2 and outer bin piece 3. The inner bin piece 2 and the outer bin piece 3 are part of the bin which will drop open when the latch 16 of the present invention is opened. The shaft end location is designated by reference numeral 1.

Figure 4:
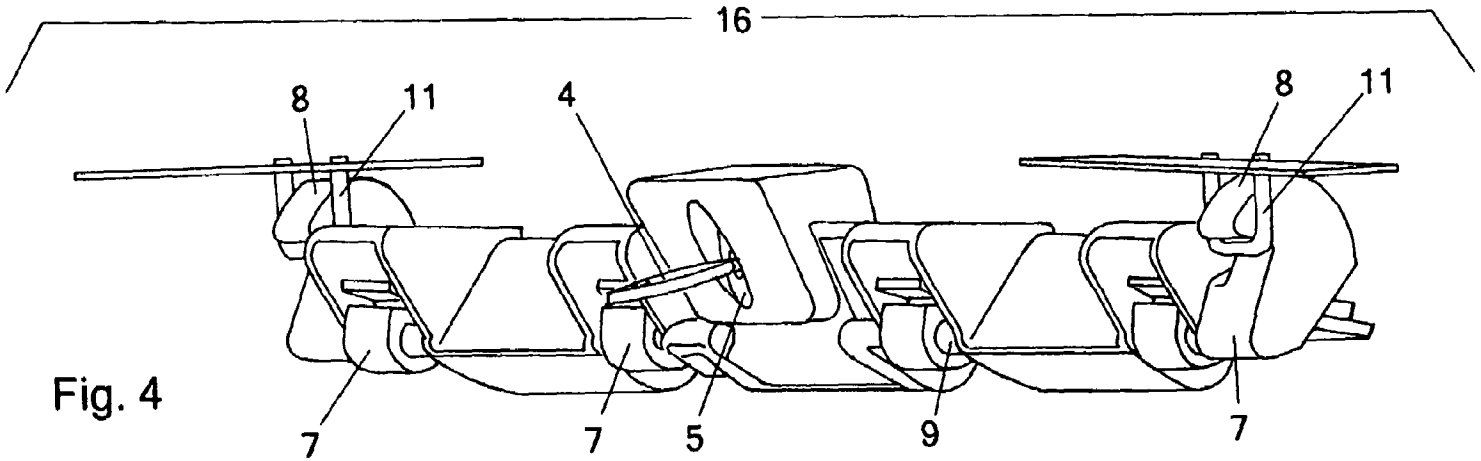
FIG. 4 is a view of the latch of FIG. 1 in the closed position.
Figure 5:
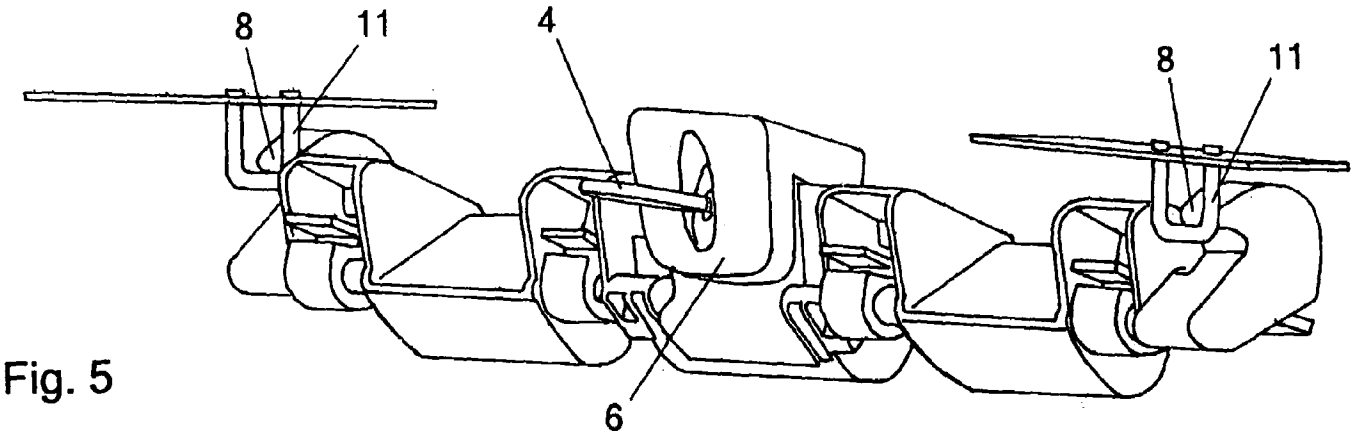
FIG. 5 is a view of the latch of FIG. 1 in the open position.
Figure 6:
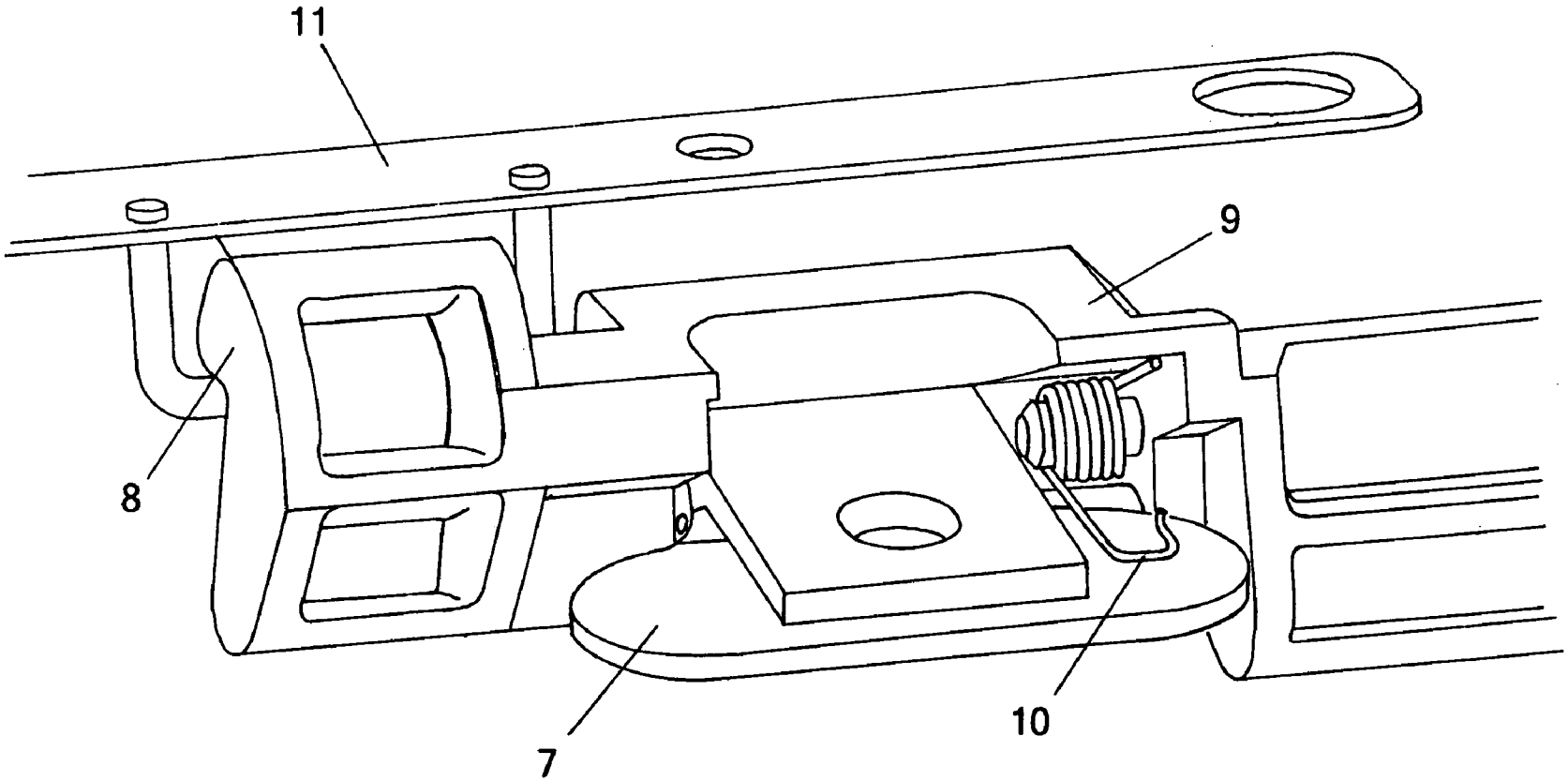
FIG. 6 is a rear view of a tie down bezel, and a pawl of FIG. 1 engaged with a keeper such that the bin is retained in a closed position and a precompressed torsion spring.

A preferred embodiment of the latch 16 of the present invention is shown in FIGS. 4–6. Two pawls 8 are at the end of the shaft 9. A precompressed torsion spring 10 presses against a tie down bezel 7 which is fixed to the inner bin piece 2 in FIG. 6. A key 4 can be fitted into a lockplug 5 which in turn is located in a button 6. The button 6 is part of the one-piece, monolithic button pawl shaft 9.

FIG. 4 is a view of the latch 16 of FIG. 1 in the closed position shown with pawls 8 engaging keepers 11. FIG. 5 is a view of the latch 16 of FIG. 4 in the open position shown with the pawls 8 clearing keepers 11.

Figure 7:
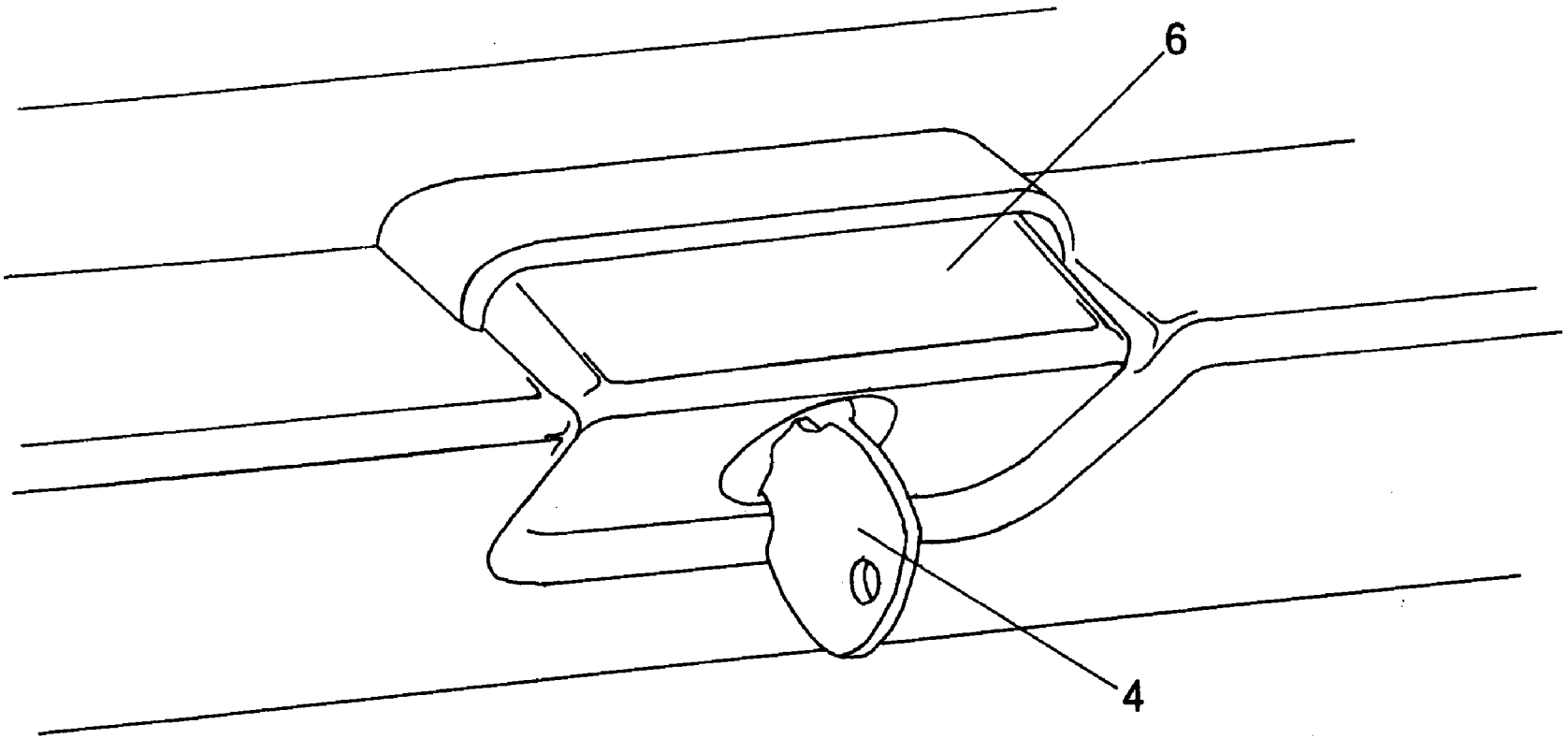
FIG. 7 is a perspective view of a button and key on the latch of FIG. 1 in the closed and locked position.
Figure 8:
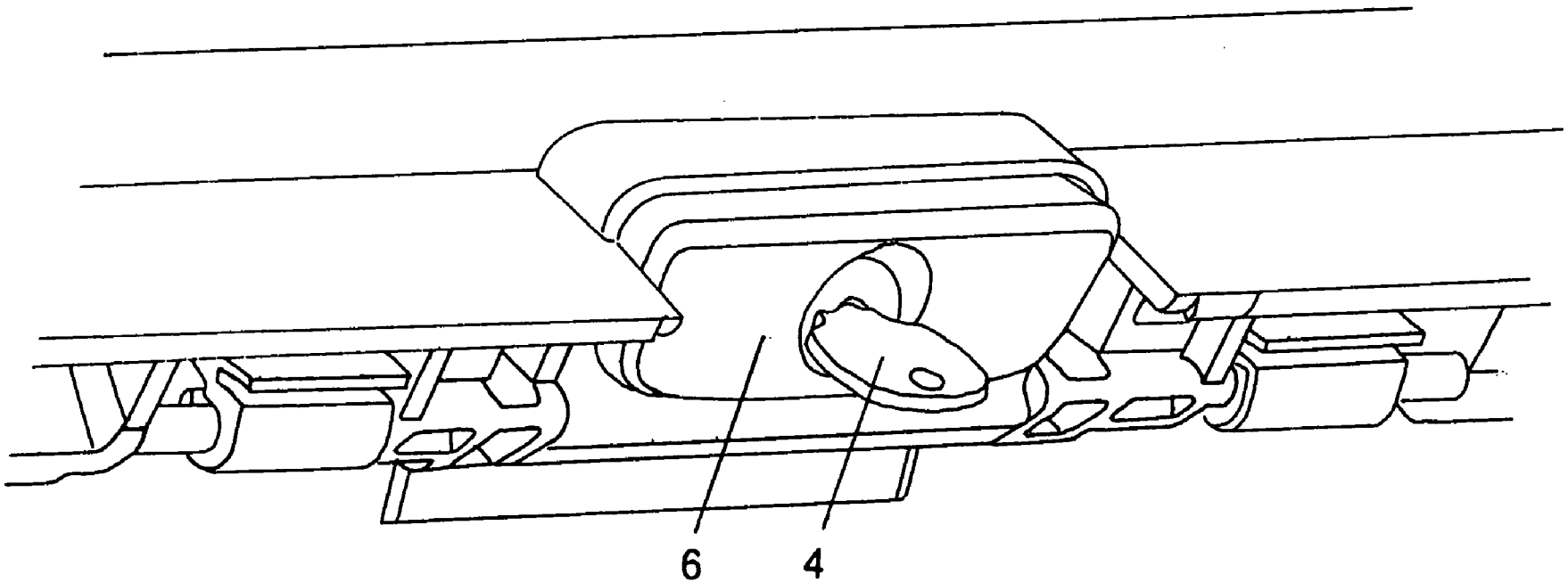
FIG. 8 is a perspective view of a button, shaft and key on the latch of FIG. 1 in the closed and unlocked position.
Figure 9:
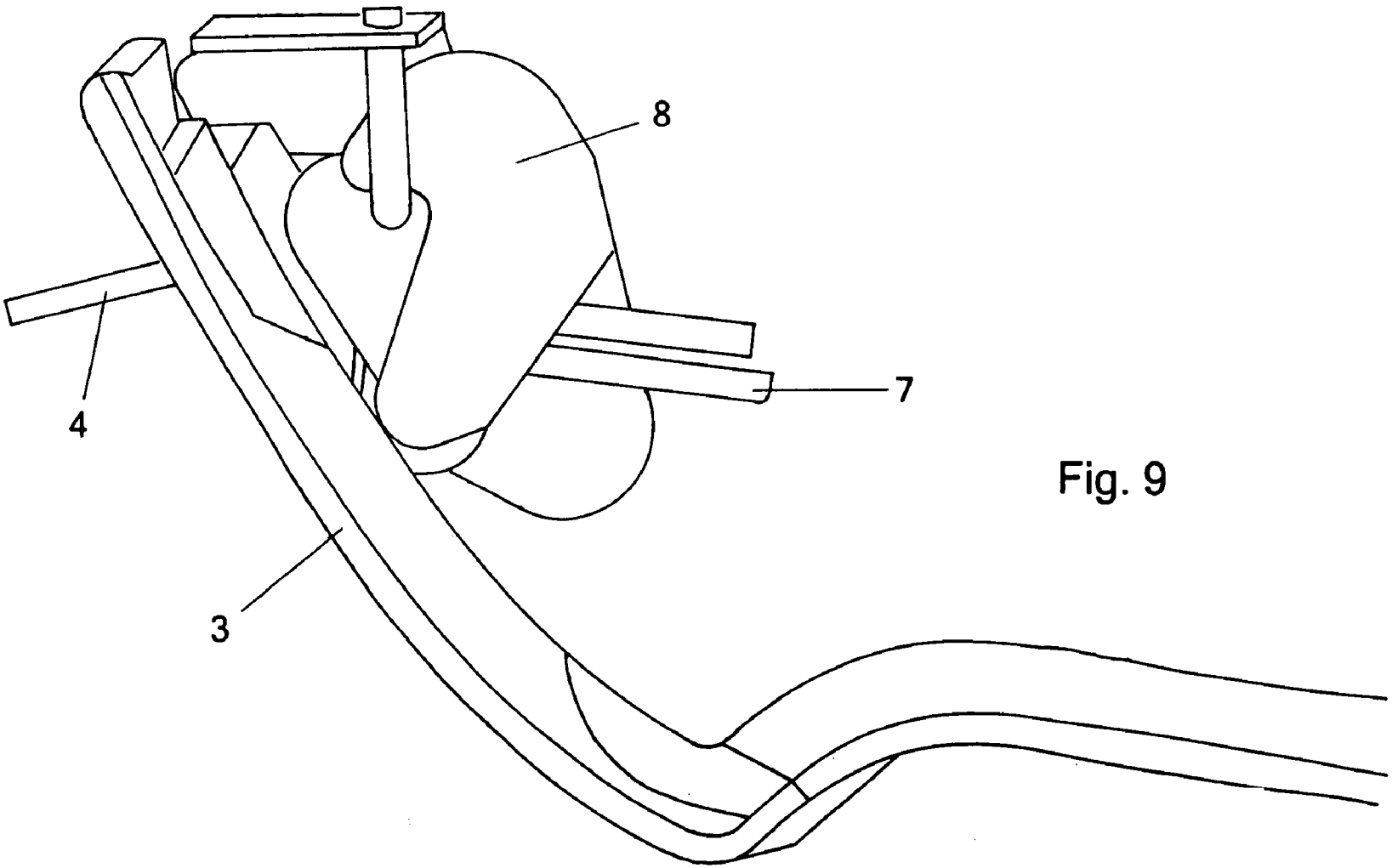
FIG. 9 is a side view of an outer bin piece, and a key, and a pawl engaged in a keeper of FIG. 1 such that the bin is retained in a closed position.

FIG. 7 shows button 6 and key 4 of the latch 16 of FIG. 1 in the closed and locked position. FIG. 8 shows the button 6 and key 4 on the latch 16 in the closed and unlocked position after the key 4 has been rotated approximately 90 degrees. FIG. 8 shows the button 6 in a pressed position. FIG. 9 is a side view of the button 6, shaft 9 and key 4 on the latch 16 of FIG. 1 in the closed and unlocked position.

Figure 10:
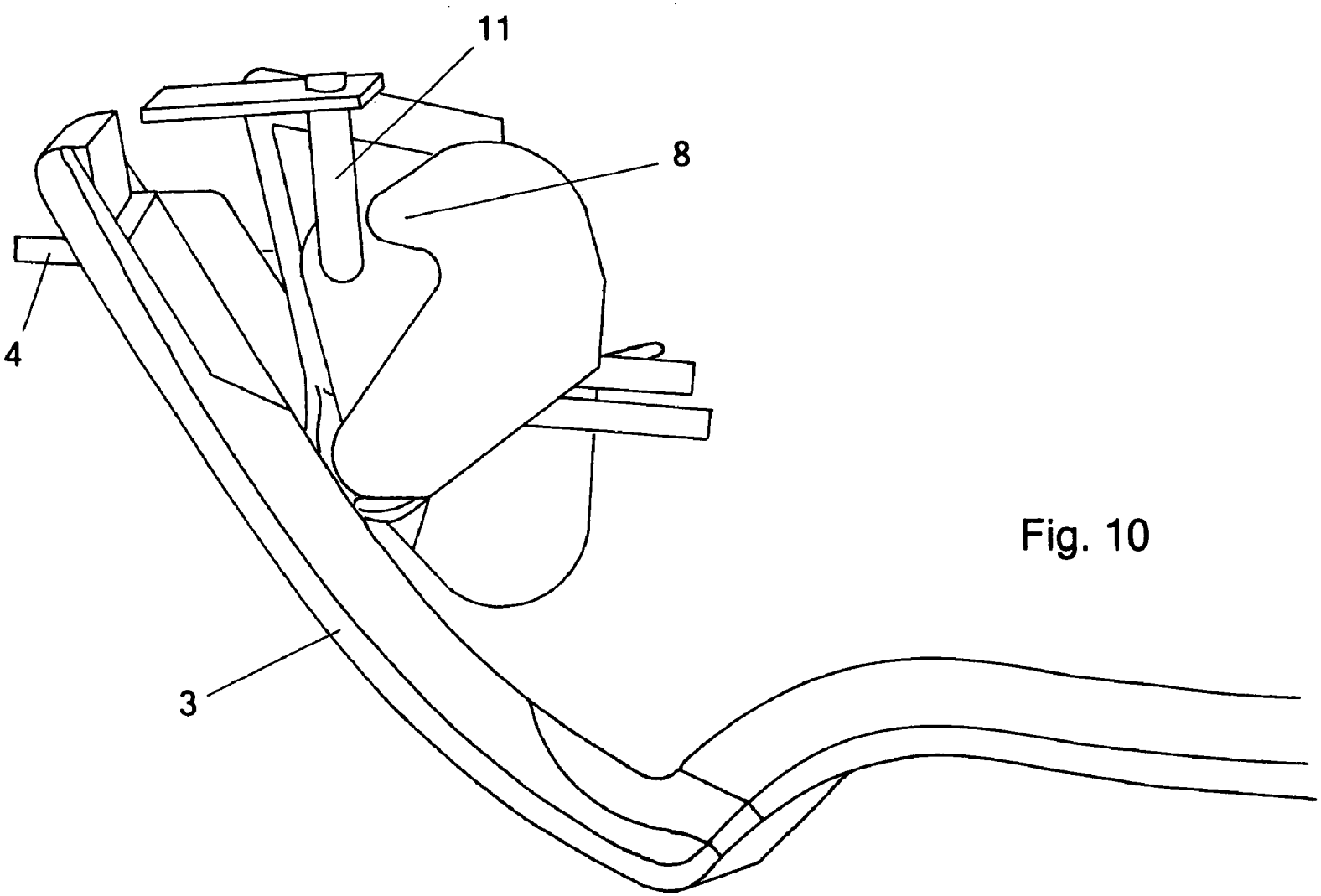
FIG. 10 is a side view of an outer bin piece and a key and a pawl of FIG. 1 which clears a keeper such that the bin drops down to an open position in the present invention.

As shown in FIG. 10, upon unlocking of the lockplug 5, the shaft 9 and pawl 8 rotate and clear keepers 11. In FIG. 10, the latch 16 is in an open position and the pawls 8 clear the keepers 11. As can be seen in FIG. 10, the pawls 8 clear the keeper 11 and permit rotation of the shaft 9 thereby allowing the outer bin piece 2 and the lower bin piece 3 to drop away due to their own weight from a panel connected to the keepers 11. When the lower bin drops open, the lower bin rotates about hinges.

The one-piece button pawl shaft 9 has a tensioning force applied to it by torsion spring 10 which applies a force to bezel 7 as shown in FIG. 6

Figure 12:
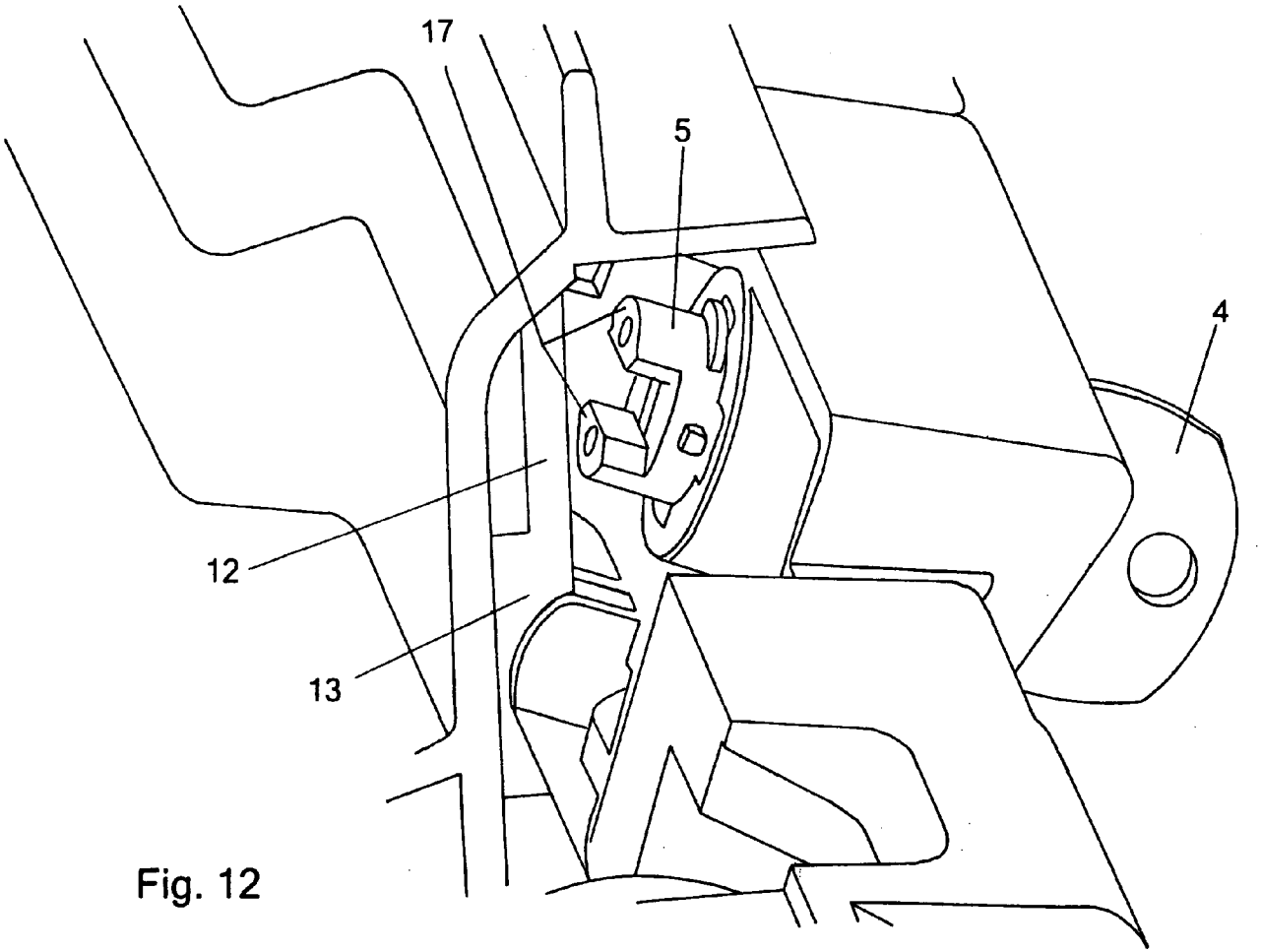
FIG. 12 is a view of a section of an inner bin piece and shaft of FIG. 1 showing a lockplug directly against an upper rib and the shaft of the latch engaged with a lower rib in a locked position.
Figure 13:
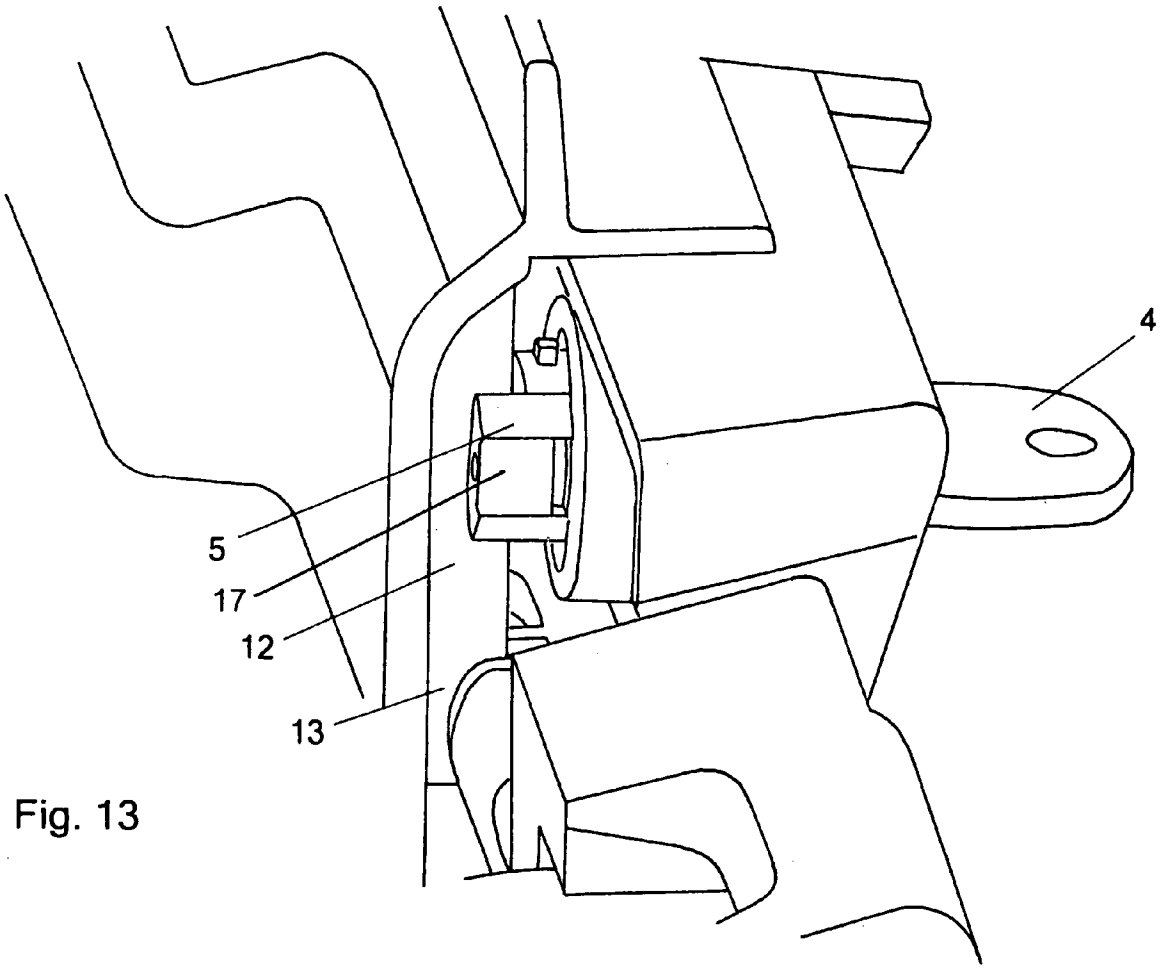
FIG. 13 is a view of a section of an inner bin piece and shaft of FIG. 1 in a locked position showing an upper rib which falls between portions of a lockplug and showing that the shaft is engaged with a lower rib during rotation in order to keep the correct clearance between the lockplug and the upper rib in the Y axis.

The bezels 7 are fixed into position on the inner bin piece 2 and do not rotate. An upper rib 12 and a lower rib 13 are shown in FIG. 12 and 13 on inner bin piece 2. Flats 14 are also shown which give the latch 16 position in the Z axis. The inner bin 2 has screw bosses 15 for attaching the bezels 7 in which the shaft 9 of the latch 16 rotates.

FIG. 12 and 13 show views of a section of the latch 16 as the lockplug 5 is rotated 90 degrees so that the key 4 is rotated into the horizontal position. At that point, portions of the lockplug 5 clear the upper rib 12 and allow for rotational movement of the shaft 9. In addition, as the shaft 9 rotates portions of the shaft 9 are aligned and engaged with the lower rib 13 so that the proper clearance is maintained between lockplug 5 and the upper rib 12.

The assembly of the latch 16 can be performed easily by placing the four torsion springs 10 on the shaft 9 and snapping the four tie down bezels 7 into place. The lockplug 5 is then installed through a hole in the lockplug 5. In its final form, the latch 16 is installed sandwiched between the inner bin piece 2 and the outer bin piece 3.

In FIG. 12 and 13, the key 4, which can be removed at any time, is rotated 90 degrees and the button 6, which is a part of the one-piece button pawl shaft 9, is pressed to rotate the button pawl shaft 9.

It can be seen that the forces of the precompressed torsion spring 10 allow the bin to be retained in a closed position. When the shaft 9 rotates, as shown in FIG. 4–6 the torsion spring 10 is compressed. When effort on the spring 10 is released after the pawls 8 have cleared the keepers 11, the spring pushes the shaft 9 back to a closed position. When it is desired that the bin be closed and the latch 16 be relatched, the bin can be slammed shut and due to the ramp shape on the top surface of the pawls 8, the pawls 8 are forced to rotate backward and the springs 10 are compressed. After the pawls 8 have cleared the keepers 11, the torsion springs 10 relax and the pawls 8 rotate back above the striker wire of the keepers 11, thus completing the latching process.

Figure 11:
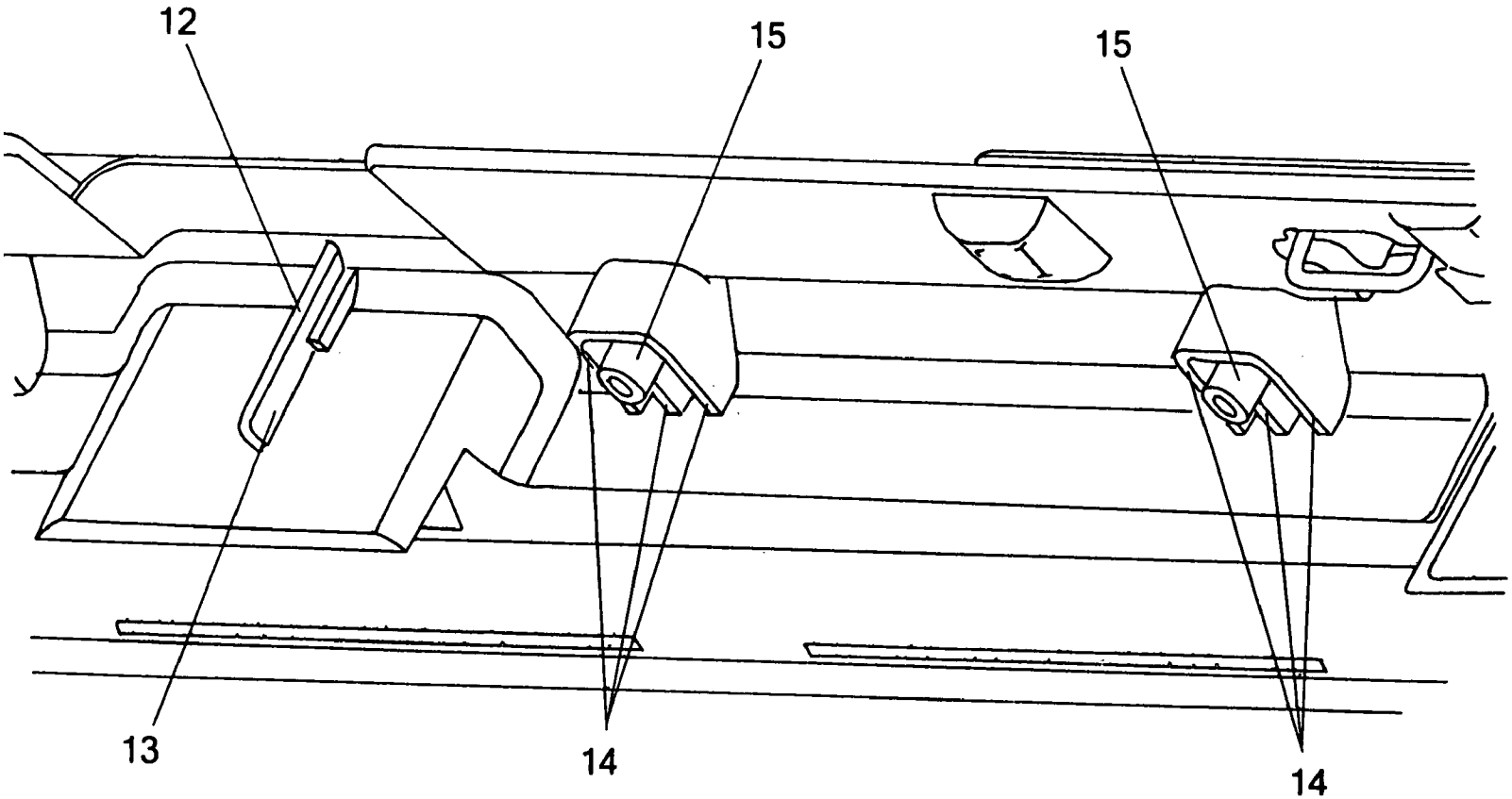
FIG. 11 is a view of ribs and flats on an inner bin piece which give the latch of FIG. 1 position in the Z axis.

The tie down bezels 7 are fixed in position on inner bin piece screw bosses 15 which are near flats 14 as shown in FIG. 11 on the inner bin piece 2. The flats 14 give the latch 16 position in the Z axis.

The 90 degree rotation of the lockplug 5 is shown from a first position in FIG. 12 to a rotated position in FIG. 13 at which opposed protuberances 17 on lockolug 5 can clear rib 12.

Figure 14:
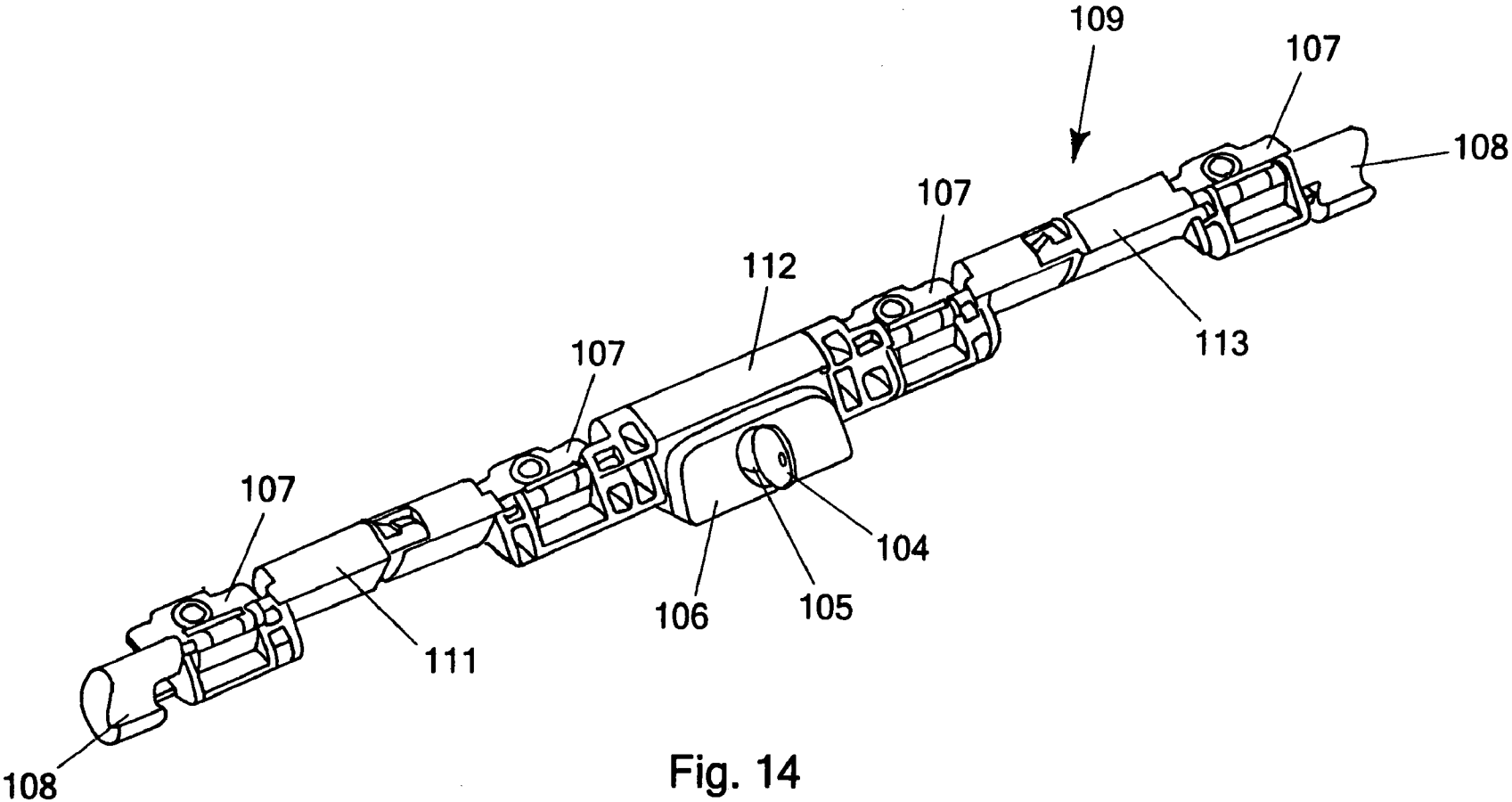
FIG. 14 is a perspective view of a second embodiment of a button pawl shaft in accordance with the present invention with a key inserted into a lock plug in the button of the button pawl shaft.
Figure 18:
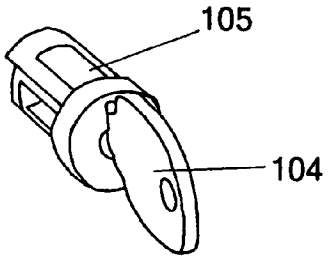
FIG. 18 is a perspective view of the lockplug and key of the button pawl shaft of FIG. 14.

A second embodiment of the button pawl shaft of the present invention is shown in FIG. 14. Two pawls 108 are at the ends of the button pawl shaft 109. A precompressed torsion spring (not shown) presses against each of bezels 107 which is fixed to a lower structure (not shown) which the user intends to fasten to an upper structure (not shown). A key 104 shown in FIG. 18 can be fitted into a lockplug 115 which in turn is located in a button 106. The button 106 is part of the button pawl shaft 109. Also shown in FIG. 14 is a left shaft piece 111, a center shaft piece 112, and a right shaft piece 113.

Figure 15:
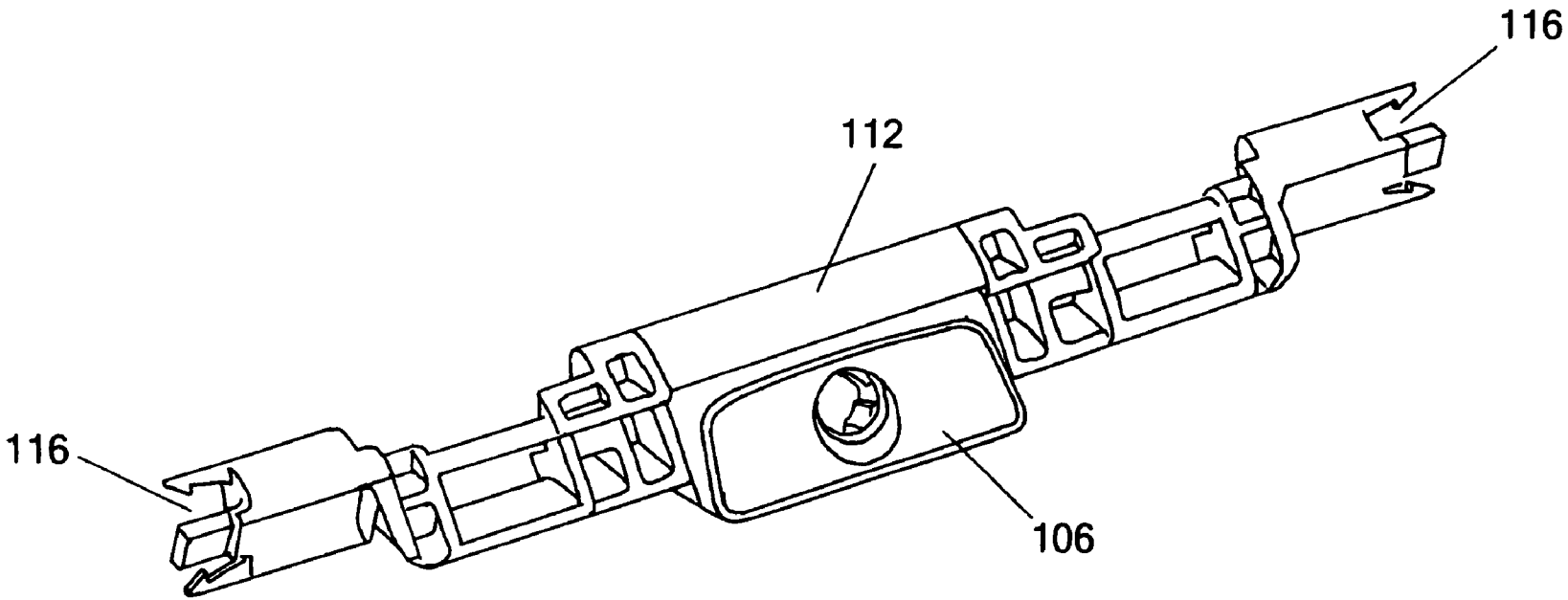
FIG. 15 is a perspective view of the center shaft piece of the button pawl shaft of FIG. 14.

FIG. 15 is a perspective view of the center shaft piece 112 of the button pawl shaft 109 of FIG. 14. Recesses 116 are shown at opposite ends of center shaft piece 112. Button 106 is also shown and rotates the button pawl shaft 109 when a user presses on the button 106 when the button 106 is not placed in a locked position by lockplug 105.

Figure 17:
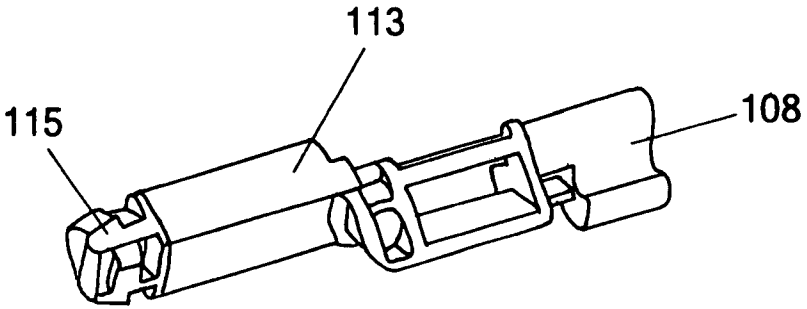
FIG. 17 is a perspective view of the right shaft piece of the button pawl shaft of FIG. 14.
Figure 16:
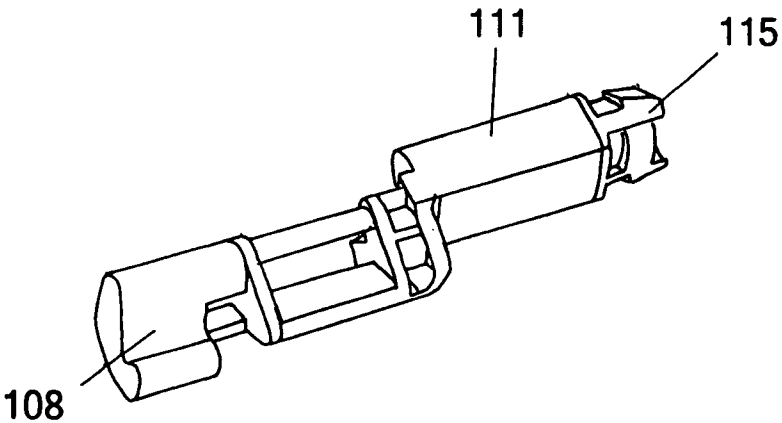
FIG. 16 is a perspective view of the left shaft piece of the button pawl shaft of FIG. 14.
Figure 21:
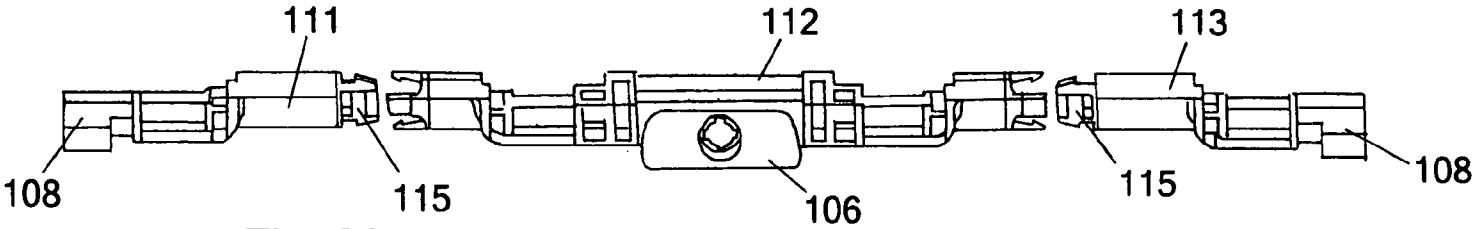
FIG. 21 is a side view of the center shaft piece, the left shaft piece, and the right shaft piece of the button pawl shaft of FIG. 14.
Figure 23A:
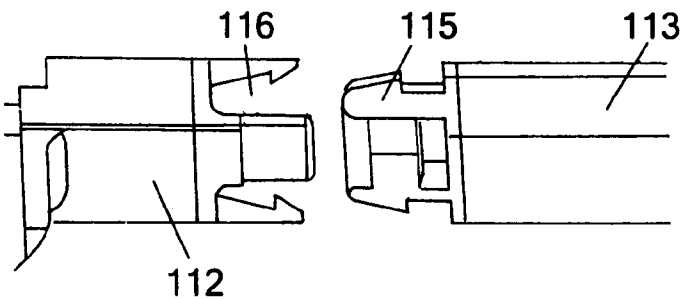
FIG. 23*a* is a side view of a portion of the center shaft piece and a portion of the right shaft piece of FIG. 14 in an unassembled configuration.

FIG. 16 shows left shaft piece 111 having pawl 108 and protuberance 115 at one end of left shaft piece 111. Similarly, FIG. 17 shows right shaft piece 113 having pawl 108 and protuberance 115 at one end of the right shaft piece 113. FIG. 21 shows the left shaft piece 111, center shaft piece 112, and right shaft piece 113. Left shaft piece 111 and right shaft piece 113 are shown with protuberances 115 at one end. Protuberance 115 of left shaft piece 111 snap fits into recess 116 of center shaft piece 112. In addition, protuberance 115 of right shaft piece 113 snap fits into recess 116 of the other end of center shaft piece 112.

Figure 22A:
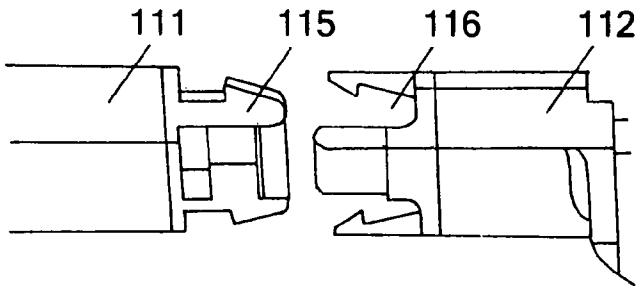
FIG. 22*a* is a side view of a portion of the left shaft piece and a portion of the center shaft piece of FIG. 14 in an unassembled configuration.
Figure 23B:
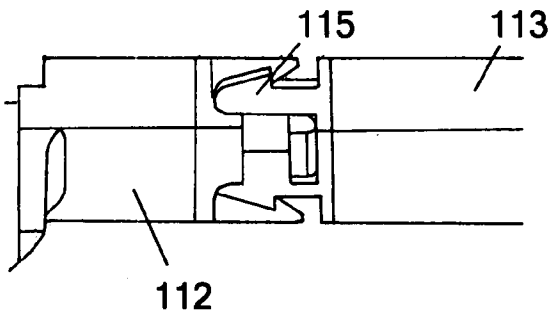
FIG. 23*b* is a side view of a portion of the center shaft piece and a portion of the right shaft piece of FIG. 14 in an assembled configuration.
Figure 22B:
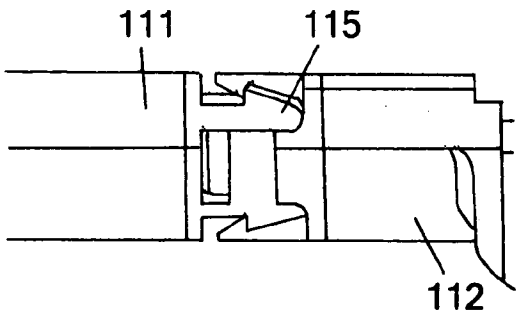
FIG. 22*b* is a side view of a portion of the left shaft piece and a portion of the center shaft piece of FIG. 14 in an assembled configuration.

As shown in FIGS. 22*a* and 22*b*, protuberance 115 of left shaft piece 111 snap fits into recess 116 of center shaft piece 112. Similarly, protuberance 115 of left shaft piece 111 snap fits into recess 116 of center shaft piece 112.

Figure 19:
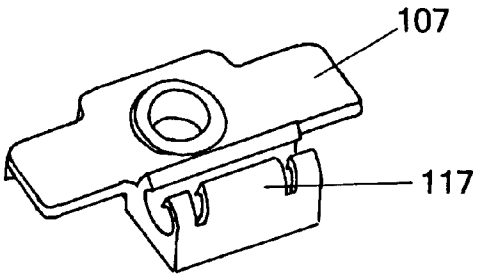
FIG. 19 is a perspective view of the snap on bezels of the button pawl shaft of FIG. 14.
Figure 20:
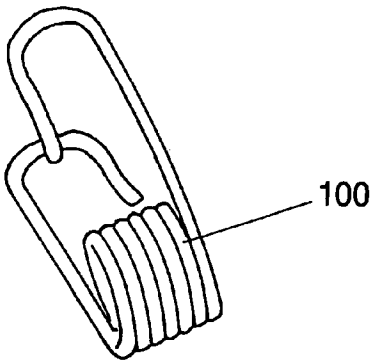
FIG. 20 is a perspective view of a torsion spring for the button pawl shaft of FIG. 14.
Figure 25:
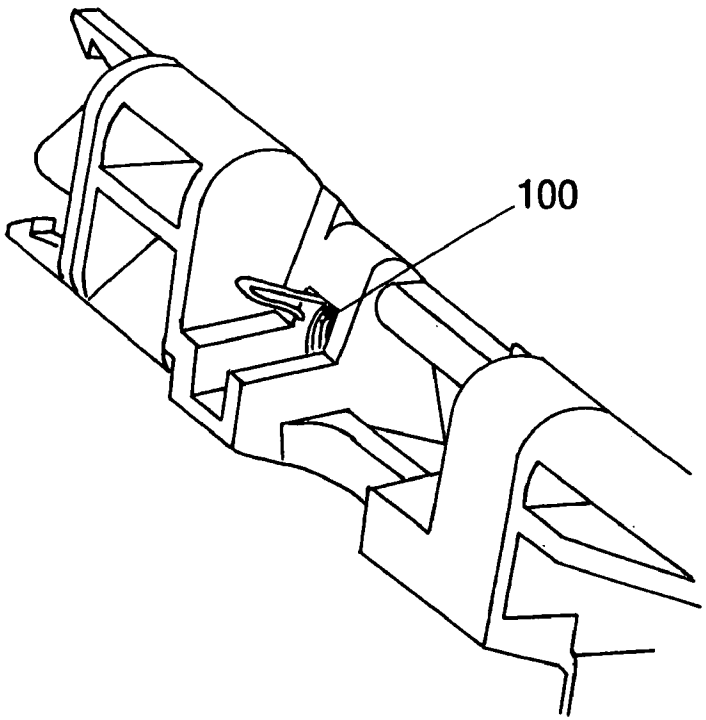
FIG. 25 is a perspective view of a torsion spring and a spring pocket of the button pawl shaft of FIG. 14 after insertion of the torsion spring in the spring pocket.
Figure 24:
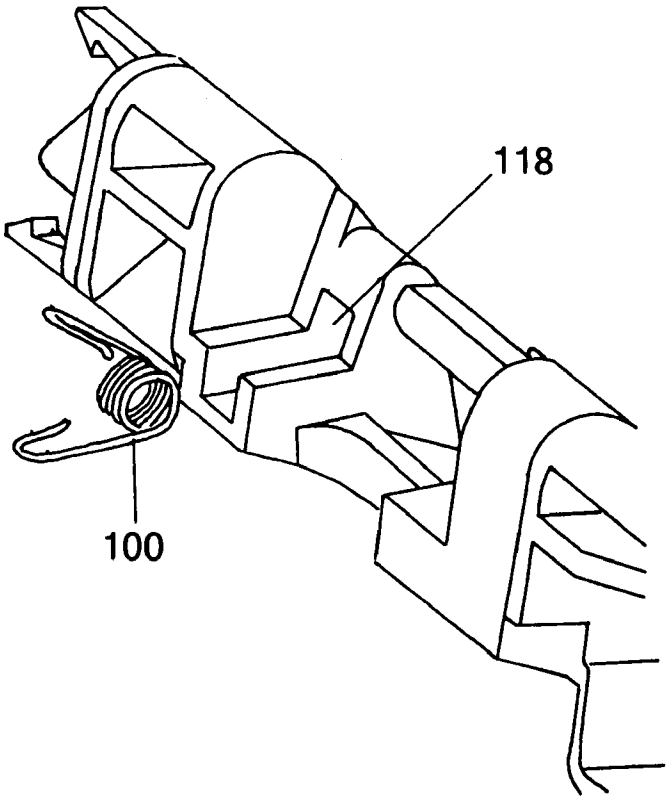
FIG. 24 is a perspective view of a torsion spring and a spring pocket of the button pawl shaft of FIG. 14 prior to insertion of the torsion spring in the spring pocket.
Figure 27:
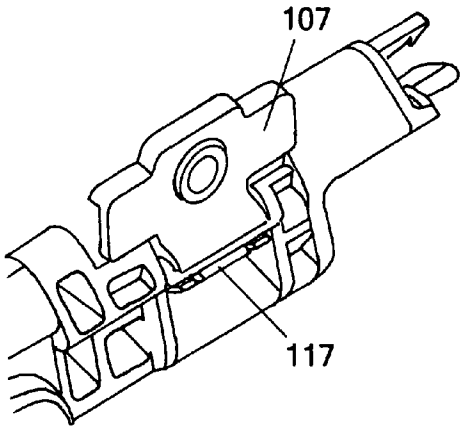
FIG. 27 is a perspective view of a bezel of FIG. 14 after being snap fit to the axis of the button pawl shaft.
Figure 29:
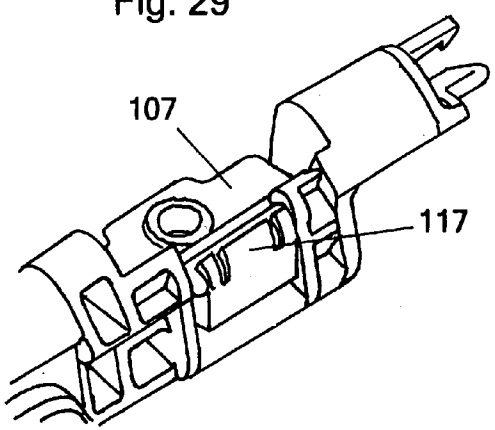
FIG. 29 is a perspective view of a bezel of FIG. 14 being rotated around the axis of the button pawl shaft to a set angle to preload the spring.
Figure 26:
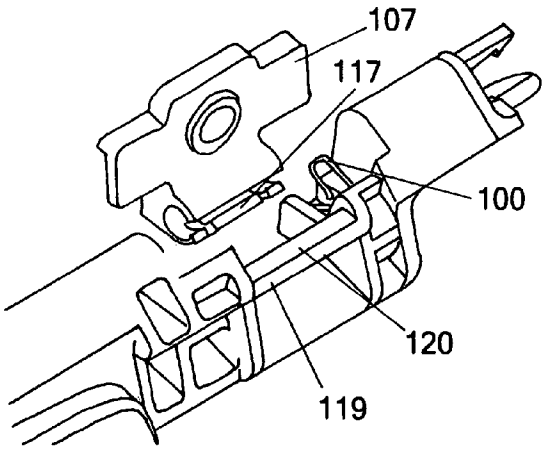
FIG. 26 is a perspective view of a bezel of FIG. 14 prior to being snap fit to the axis of the button pawl shaft.
Figure 28:
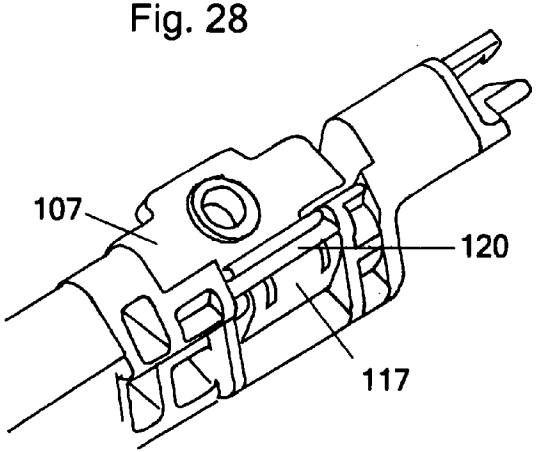
FIG. 28 is a perspective view of a bezel of FIG. 14 being rotated around the axis of the button pawl shaft.

FIGS. 20 and 24 show a torsion spring 100 which can be of plastic or metal. As shown, the windings of torsion spring 100 has a U-shape at each end. Torsion spring 100 is shown placed and retained in spring pocket 118 where it is precompressed as in FIG. 25. In the first embodiment of the present invention, a bezel 107 is shown in FIG. 19 wherein the bezel 107 has a snap fitting tongue 117. As shown in FIG. 25, bezel 107 and snap fitting tongue 117 on the bezel are shown prior to being placed on the axis 119 of button pawl shaft 109. Axis 119 has a flat portion 120 which provides a second snap position at a predetermined angle which thereby preloads the spring at the required position. The flat portions 120 assist the assembler of the button pawl shaft in placing the bezel 107 on the axis 119 of the shaft in a desired position. Bezel 107 is shown placed on the axis 119 as shown in FIG. 29. FIGS. 27 and 28 show the bezel 107 in intermediate positions as the bezel 107 rotates around the axis 119 of the button pawl shaft 109.

Figure 30:
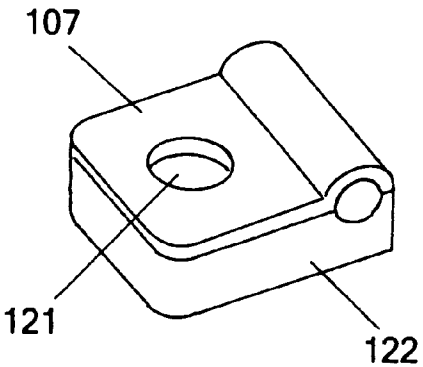
FIG. 30 is a perspective view of a bezel for a third embodiment of the present invention.

In FIG. 30 a bezel of a third embodiment of the present invention is shown in a two piece configuration. The bezel 107 is provided with an aperture 121. In this embodiment, rather than being snap fit onto the axis 119 of the button pawl shaft 109, the bezel 107 can be clamped onto the axis when in combination with bottom piece 122.

Figure 31:
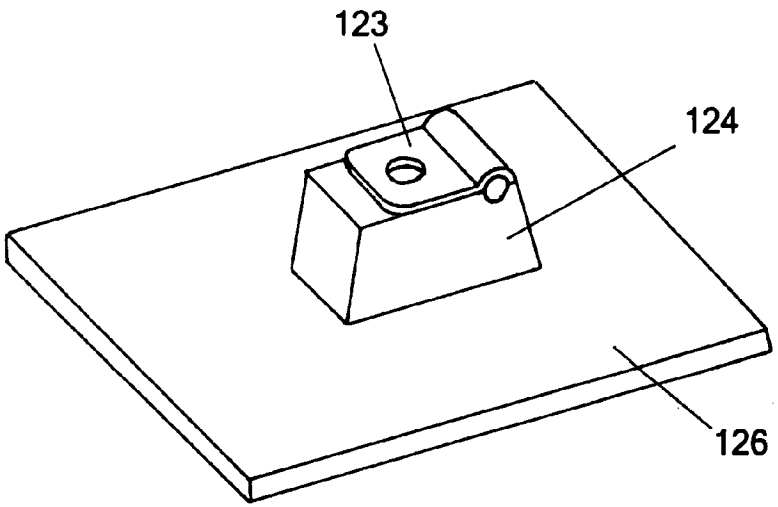
FIG. 31 is a perspective view of a bezel for a fourth embodiment of the present invention.

In FIG. 31, a bezel of a fourth embodiment is shown wherein essentially a half-bezel 123 is provided and the lower structure 126 which is to be fastened has a bottom half 124 of a bezel-shaped structure thereby forming a bezel. The two pieces together form a bezel in which the axis of the button pawl shaft 109 can be inserted.

Figure 32:
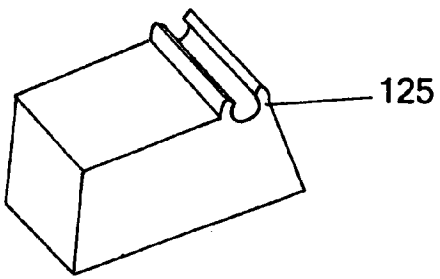
FIG. 32 is a perspective view of a bezel for a fifth embodiment of the present invention.

In FIG. 32, a bezel of a fifth embodiment is shown wherein the lower structure 126 which is to be fastened has a structure having a snap fit portion 125 which can be snap fit to the axis 119 of the button pawl shaft 109.

The above three alternate versions of bezels can be provided with wings for acting on the torsion spring 100 of the button pawl shaft 109.

After assembly of the button pawl shaft of the present invention using one of the above-mentioned bezels, the one-piece button pawl shaft 109 has a tensioning force applied thereon by torsion spring 100 which applies a force to the bezels.

The assembly of the button pawl shaft can be performed easily by placing the four torsion springs 100 in the spring pockets 118 even prior to shipment of the pieces of the button pawl shaft 109 to the location where the button pawl shaft 109 will be assembled. At the assembly location, the left shaft piece 111 is inserted into the center shaft piece 112 and the right shaft piece 113 is inserted into the other end of the center shaft piece 112. In its final form, the assembled button pawl shaft 109 is installed on a lower structure which a user desires to repeatedly fasten and unfasten from an upper structure. In its final installation location, the pawls of the button pawl shaft 109 engage a keeper which is installed on the upper structure.

It can be seen that the forces of the precompressed torsion spring 100 allow the lower structure to be retained in a closed position relative to the upper structure. When the button pawl shaft 109 rotates, the torsion spring 100 is compressed. When effort on the spring 100 is released after the pawls 108 have cleared the keepers on the upper structure, the torsion spring 100 pushes the button pawl shaft 109 back to a closed position. When it is desired that the lower structure be closed and the button pawl shaft 109 relatched, the lower structure such as a bin can be slammed shut and due to the ramp shape on the top surface of the pawls 108. The pawls 108 are forced to rotate backward and the springs 100 are compressed. After the pawls 108 have cleared the keepers, the torsion springs 100 relax and the pawls 108 rotate back above the keepers, thus completing the latching process.

It will be recognized by those skilled in the art that changes may be made by the above-described embodiments of the invention without departing from the broad inventive concepts thereof. For example, each of the features described above do not all need to be included in a single device. Rather, one or more features can be provided in a single device where desired and in any combination. It is understood, therefore, that this invention is not limited to the particular embodiment disclosed, but it is intended to cover all modifications which are within the scope and spirit of the invention.

We claim:

1. A button pawl shaft for releasably latching a first panel to a second panel comprising a shaft connected to one of the first and second panels, said shaft having:

two opposite ends;

a pawl on each of said two opposite ends of said shaft, each of said pawls having a portion thereof which is shaped so as to be engageable with a respective keeper on the second panel upon rotation of said shaft;

at least one pocket within said shaft;

a spring located in said at least one pocket, said pocket configured to receive the outer periphery of a central portion of said spring therein, wherein said spring applying a biasing force which urges said shaft to rotate said pawls toward the keeper, and a button on said shaft between said pawls, said button permitting rotation of the shaft in a direction opposite to that of the biasing force when a force is applied to said button such that each of said pawls can disengage the keeper on the second panel.

2. The button pawl shaft of claim 1 further comprising at least one bezel along said shaft in which said shaft rotates, said bezel connecting said shaft to the first panel.

3. The button pawlshaft of claim 2 wherein said spring is a torsion spring.

4. The button pawlshaft of claim 2 wherein said spring is precompressed in said pocket.

5. The button pawl shaft of claim 2 further comprising a lock plug arranged on said button, said lock plug having opposed protuberances on a side facing one of the first and second panels, said opposed protuberances being positioned to deny rotation of the shaft when said lock plug is in a locked state due to contact of said opposed protuberances with a rib on one of the first and second panels and permitting rotation of the shaft when said lock plug is in an unlocked state.

6. The button pawl shaft of claim 1 wherein said shaft is monolithic.

7. The button pawl shaft of claim 1 wherein at least a portion of each of said pawls which engages with a respective keeper is ramp-shaped.

8. A latch comprising the button pawl shaft of claim 1.

9. The button pawl shaft of claim 1 wherein the shaft comprises:

a center shaft piece, said center shaft piece having at least one recess at each of two opposite longitudinal ends of said center shaft piece;

a first end shaft piece and second end shaft piece, each of said first and second end shaft pieces having:

a protuberance at an end thereof, each protuberance being engaged with a respective recess of the center shaft piece.

10. The button pawl shaft of claim 9 further comprising at least one bezel along said button pawl shaft in which said button pawl shaft rotates, said bezel being fixed to one of said first and second panels wherein a portion of said button pawl shaft is snap fit into said bezel.

11. The button pawl shaft of claim 10 wherein the portion of the button pawl shaft which rotates in said bezel has a flat portion which provides a detent position during rotation of the shaft.

12. The button pawl shaft of claim 9 further comprising at least one bezel along said button pawl shaft in which said button pawl shaft rotates, wherein a first portion of said bezel is fixed to one of said first and second panels and a remaining portion of said bezel can be removably separated from the first portion of the bezel and a portion of said button pawl shaft is snap fit into said bezel.

13. The button pawlshaft of claim 12 wherein said spring is a torsion spring.

14. The button pawl shaft of claim 12 wherein said spring is precompressed in said pocket.

15. The button pawl shaft of claim 10 further comprising a lock plug arranged on said button, said lock plug having opposed protuberances on a side facing one of said first and second panels, said opposed protuberances being positioned to deny rotation of the shaft when said lock plug is in a locked state due to contact of the opposed protuberances with a rib on one of said first and second panels and permitting rotation of the shaft when said lock plug is in an unlocked state.

16. The button pawl shaft of claim 9 wherein at least a portion of each of said pawls which engage with a respective keeper is ramp-shaped.

17. A latch comprising the button pawl shaft of claim 9.

* * * * *